US007141085B2

(12) United States Patent
Groen et al.

(10) Patent No.: US 7,141,085 B2
(45) Date of Patent: Nov. 28, 2006

(54) REFRACTORY PROTECTED REPLACEABLE INSERT

(75) Inventors: John Corwyn Groen, Fishkill, NY (US); John D. Winter, Katy, TX (US)

(73) Assignees: Texaco Inc., San Ramon, CA (US); Texaco Development Corporation, San Ramon, CA (US)

( * ) Notice: Subject to any disclaimer, the term of this patent is extended or adjusted under 35 U.S.C. 154(b) by 624 days.

(21) Appl. No.: 10/345,617

(22) Filed: Jan. 16, 2003

(65) Prior Publication Data

US 2003/0140558 A1 Jul. 31, 2003

Related U.S. Application Data

(60) Provisional application No. 60/351,070, filed on Jan. 23, 2002.

(51) Int. Cl.
*C01J 3/18* (2006.01)

(52) U.S. Cl. ..... 48/62 R; 48/69; 48/77; 48/74; 48/87; 48/89; 48/119; 48/126; 422/164; 422/184.1; 422/232; 422/240; 422/241

(58) Field of Classification Search ..... 48/89–101, 48/119, 126; 422/206, 207; 202/217–224
See application file for complete search history.

(56) References Cited

U.S. PATENT DOCUMENTS

| | | | |
|---|---|---|---|
| 1,673,640 | A | 6/1928 | Rau |
| 1,807,868 | A | 6/1931 | Nygaard |
| 1,936,151 | A | 11/1933 | Allen et al. |
| 2,809,104 | A | 10/1957 | Strasser et al. |
| 3,802,833 | A | 4/1974 | Weber |
| 3,832,478 | A | 8/1974 | Books |
| 3,850,755 | A | 11/1974 | Welty |
| 3,878,053 | A | 4/1975 | Hyde |
| 4,255,072 | A | 3/1981 | Gappa et al. |
| 4,545,860 | A | 10/1985 | Lyskawa et al. |
| 4,808,197 | A | 2/1989 | Ayers |
| 4,828,579 | A | 5/1989 | Becker et al. |
| 4,828,580 | A | 5/1989 | Dach |

(Continued)

OTHER PUBLICATIONS

International Search Report, International Application No. PCT/US03/01486, Date of International Search Apr. 1, 2003, Date of Mailing Apr. 21, 2003, 1 page.

*Primary Examiner*—Glenn Caldarola
*Assistant Examiner*—Vinit H. Patel
(74) *Attorney, Agent, or Firm*—Cantor Colburn LLP

(57) ABSTRACT

The refractory protected, replaceable insert for a gasifier includes a replaceable floor edge insert that is formed with a predetermined mating profile that is complementary to a finished mating profile of the gasifier floor. The geometry of the mating profiles of the replaceable floor edge insert and the gasifier floor permit removable engagement between the floor edge insert and the mating profile of the gasifier floor. The replaceable floor edge insert is protected by a ring-like arrangement of hanging refractory bricks that each include an appendage. Each brick appendage covers a portion of the inner radial edge of the replaceable floor edge insert and also covers an upper surface portion of an underlying quench ring, thus prolonging the life of the floor and the quench ring. A refractory ceramic fiber paper can be provided between the hanging brick and the floor edge and quench ring. Also, a refractory ceramic fiber rope can be provided at the inner peripheral edge of the replaceable floor edge insert upon the upper surface of the quench ring, and overlaid by the appendage.

16 Claims, 7 Drawing Sheets

U.S. PATENT DOCUMENTS 5,464,592 A * 11/1995 Brooker et al. ..... 422/207
5,484,554 A 1/1996 Vuong et al.
5,554,202 A 9/1996 Brooker et al.
5,785,721 A * 7/1998 Brooker ..... 48/86 R
5,851,497 A 12/1998 Brooker et al.
6,228,224 B1 * 5/2001 Brooker ..... 202/224

* cited by examiner

REFRACTORY PROTECTED REPLACEABLE INSERT

BACKGROUND OF THE INVENTION

This invention is directed to gasifiers and more particularly to a novel replaceable insert for a gasifier floor, and a novel refractory hanging brick for protecting an edge portion of the gasifier floor, especially the replaceable insert for the gasifier floor.

Gasifiers are generally used for processing carbonaceous fuels, including coal, petroleum coke, gas and/or oil, to produce gaseous mixtures of hydrogen and carbon monoxide, such as coal gas, synthesis gas, reducing gas and fuel gas.

Partial oxidation gasifiers of the type shown in U.S. Pat. No. 2,809,104 and U.S. Pat. No. 5,484,554 include a high temperature reaction chamber surrounded by one or more layers of insulating and refractory material, such as fire clay brick, also referred to as refractory brick or refractory lining, and encased by an outer steel shell or vessel.

A feed injector such as shown in U.S. Pat. No. 4,443,230 and U.S. Pat. No. 4,491,456, can be used with gasifiers of the type shown in the previously referred to patents to introduce pumpable slurries of carbonaceous fuel, such as a coal-water slurry, downwardly into a reaction chamber of the gasifier along with oxygen containing gases for partial oxidation.

During operation of the gasifier typical reaction chamber temperatures can range from approximately 2200° F. to 3000° F. Operating pressures can range from 10 to 200 atmospheres. Thus, the coal-water slurry that passes through the feed injector nozzle normally self-ignites at the operating temperatures of the gasifier.

As the coal-water slurry reacts within the gasifier, one of the reaction products is gaseous hydrogen sulfide, a well known corrosive agent. Molten or liquid slag is also formed during the gasification process, as a by-product of the reaction between the coal-water slurry and the oxygen containing gas. Slag is also a well known corrosive agent and gradually flows downwardly along the inside walls of the gasifier to a water bath of the type shown in U.S. Pat. No. 5,464,592. The water bath cools the syngas exiting from the reaction chamber and also cools any slag that drops into the water bath.

Before the downflowing molten slag reaches the water bath, it flows through a throat section at a floor portion of the gasifier and closely past a quench ring and dip tube that leads to the water bath. The quench ring, which is formed of a chrome nickel iron alloy or nickel based alloy such as Incoloy®, is arranged to spray or inject water as a coolant against the inner surface of the dip tube. However some portions of the quench ring are in the flow path of the downflowing molten slag, and the quench ring can thus be contacted by molten slag. The portions of the quench ring that are contacted by slag may experience temperatures of approximately 1800° F. to 2800° F. The quench ring thus is vulnerable to thermal damage and thermal chemical degradation. Slag may also solidify on the quench ring and accumulate to form a plug that can restrict or eventually close the throat opening. Furthermore any slag accumulation on the quench ring will reduce the ability of the quench ring to perform its cooling function.

In one known gasifier the metal floor portion of the reaction chamber is in the form of a frustum of an upside down conical shell. The metal floor is usually made of the same pressure vessel metallurgy as the gasifier shell or vessel. The throat structure for the gasifier is provided at a central opening in the gasifier floor.

The metal gasifier floor supports refractory material such as ceramic brick, that covers the metal floor, and also supports the refractory material that covers the inner surface of the gasifier vessel above the gasifier floor. The gasifier floor can also support an underlying quench ring and dip tube of the type shown in U.S. Pat. No. 5,464,592.

A peripheral edge of the gasifier floor at the throat section, also know as a leading edge, is usually exposed to the harsh conditions of high temperature, high velocity syngas (which may have entrained particles of erosive ash, depending on the nature of the feedstock) and slag. The metal floor suffers wastage in a radial direction (from the center axis of the gasifier), beginning at the leading edge and progressing radially outward until the harsh conditions created by the hot syngas are in equilibrium with the cooling effects of the underlying quench ring. The metal wasting action thus progresses radially outward from a center axis of the gasifier until it reaches an "equilibrium" point or "equilibrium" radius.

The equilibrium radius is occasionally far enough from the center axis of the gasifier and the leading edge of the floor such that there is a risk that the floor can no longer sustain the overlying refractory. If refractory support is in jeopardy, the gasifier may require premature shut down for reconstructive work on the floor and replacement of the throat refractory, a very time intensive and laborious procedure.

Another problem at the throat section of the gasifier is that the upper, curved surface of the quench ring is exposed to full radiant heat from the reaction chamber of the gasifier, and the corrosive/erosive effects of the high velocity, high temperature syngas which can include ash and slag. Such harsh conditions can also lead to wastage problems of the quench ring which, if severe enough, can force termination of gasification operations for necessary repair work. This problem is exacerbated if the overlying floor has wasted away significantly, exposing more of the quench ring to the hot gas and slag.

It is thus desirable to provide a replaceable floor insert device which enables the gasifier floor to be repaired relatively easily. It is also desirable to provide a protective refractory device for the leading edge of the floor that minimizes the rate of metallurgy wastage of the floor and any underlying quench ring.

OBJECTS AND SUMMARY OF THE INVENTION

Among the several objects of the invention may be noted the provision of a novel replaceable insert for a gasifier floor and a novel refractory device that protects the floor edge of the gasifier. A further object of the invention is to provide a refractory device that protects both the floor edge and a quench ring that underlies the floor edge. Still another object of the invention is to provide a novel method of facilitating repair of a metal gasifier floor at a throat opening and a novel method of prolonging the life of the metal gasifier floor at the throat opening.

Other objects and features of the invention will be in part apparent and in part pointed out hereinafter.

In accordance with the invention a novel replaceable metallic insert for a gasifier is provided at a floor edge of the gasifier, at the throat section. The replaceable floor edge insert is positioned at a peripheral leading edge portion of gasifier floor in a manner that facilitates future repair and/or replacement of the floor edge insert.

The edge portion of the floor is formed or finished with a predetermined profile and the replaceable floor edge insert is formed with a complementary mating profile. The replaceable floor edge insert, which can be annular, has a radially inner edge portion that becomes the leading edge of the metal gasifier floor. The replaceable floor edge insert also has a radially outer edge portion with a predetermined mating profile complementary to the profile of the finished peripheral edge portion of the floor.

Preferably the mating profiles are of a geometry that enable the replaceable floor edge insert and the finished floor edge of the gasifier to engage and remain engaged without being welded together. Thus the replaceable floor edge insert can be positioned adjacent the finished floor edge, and once positioned remain in that position, thereby facilitating installation and replacement of the replaceable floor edge insert.

For example, in some embodiments of the invention the mating profile of the replaceable floor edge insert has different stepped forms, and in another embodiment the mating profile of the replaceable floor edge insert is of mortise and tenon form. Thus the complementary mating profiles of the floor edge and the replaceable floor edge insert constitute complementary engaging means for mating of the replaceable floor edge insert with a finished peripheral edge portion of the gasifier floor.

The replaceable floor edge insert is protected by refractory hanging bricks. Each hanging brick includes an appendage that overlays a portion of the inner radial edge of the replaceable floor edge insert and also covers a portion of an upper surface of a quench ring that underlies the gasifier floor at the gasifier throat. The term "refractory hanging brick" is used herein to denote singular as well as plural of the term brick.

A layer of refractory ceramic fiber paper can also be provided between the hanging refractory brick and the replaceable floor edge insert, and between the hanging refractory brick and an upper surface of the quench ring.

In addition a coil of refractory ceramic fiber rope can be provided at the inner radial edge of the replaceable floor edge insert at the upper surface portion of the quench ring. The refractory ceramic fiber rope is confined between the refractory hanging brick, and the replaceable floor edge insert and the quench ring. The refractory hanging brick thus prolongs the life of the gasifier floor by shielding the floor edge, and also prolongs the life of the quench ring by overlaying the upper surface portion of the quench ring.

The invention further includes a method of facilitating repair of a metal gasifier floor at a throat opening in the gasifier floor. The method includes finishing an inner peripheral leading edge portion of the metal gasifier floor at the throat opening such that the peripheral edge portion has a first predetermined mating profile. The method further includes forming a replaceable floor edge insert with a radially inner edge that becomes the leading edge or free edge of the metal floor at the throat opening. The forming step includes forming a radially outer edge of the replaceable floor edge insert with a second predetermined mating profile that is complementary to the first predetermined mating profile. In addition, the method includes positioning the replaceable floor edge insert at the finished peripheral edge portion of the gasifier floor such that the complementary first and second predetermined mating profiles engage. Once such positioning is accomplished the replaceable floor edge insert which in one embodiment is annular, stays in place without being welded to the finished edge of the gasifier floor.

The method further includes prolonging the life of the metal gasifier floor at the throat opening by providing a hanging refractory brick with an appendage. The appendage of the hanging refractory brick covers the free edge of the replaceable floor edge insert and an upper surface of a quench ring that underlies the floor. The method further includes providing a refractory ceramic fiber paper to extend between the hanging refractory brick and the replaceable floor edge insert and also extend between the refractory hanging brick and the upper surface of the quench ring. The method additionally includes providing a refractory ceramic fiber rope between the free edge of the replaceable floor edge insert and the upper surface of the quench ring underneath the hanging refractory brick.

The invention accordingly comprises the constructions and methods hereinafter described, the scope of the invention being indicated in the claims.

DESCRIPTION OF THE DRAWINGS

In the drawings.

Corresponding reference numbers indicate corresponding parts throughout the several views of the drawings.

DETAILED DESCRIPTION

Figure 7:
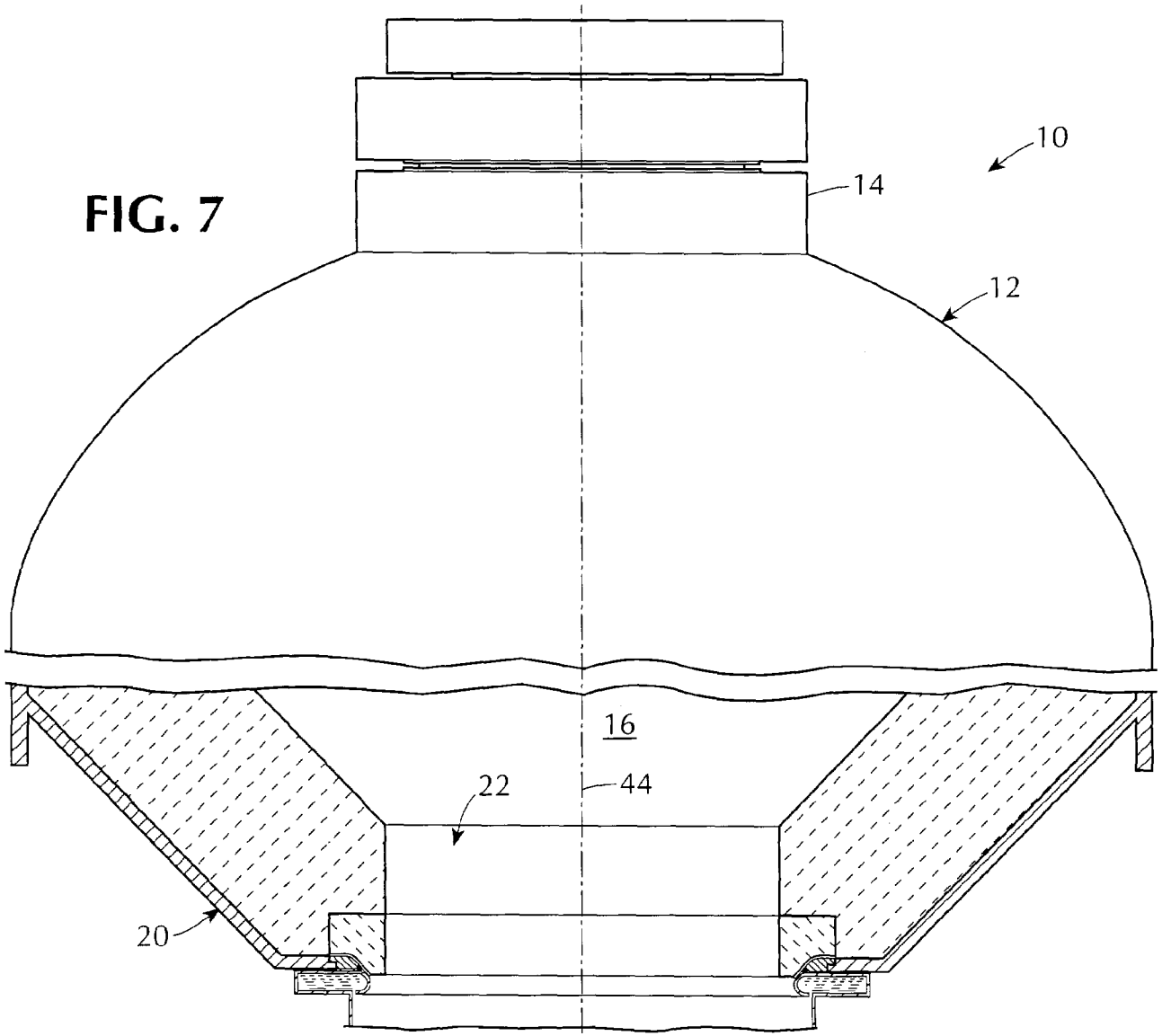

Referring to the drawings, especially FIG. 7, a gasifier is generally indicated by the reference number 10.

The gasifier 10 includes an outer steel vessel or shell 12 having a top neck portion 14, a gasification section 16 and a floor section 20. The floor section 20 is in the form of a frustum of an upside down conical shell, hereinafter referred to as a conical floor or conical floor section. An opening 22 in the floor section 20, also referred to as a throat opening or gasifier throat, leads to a quenching section, and an outlet (not shown) of the gasifier.

Figure 2B:
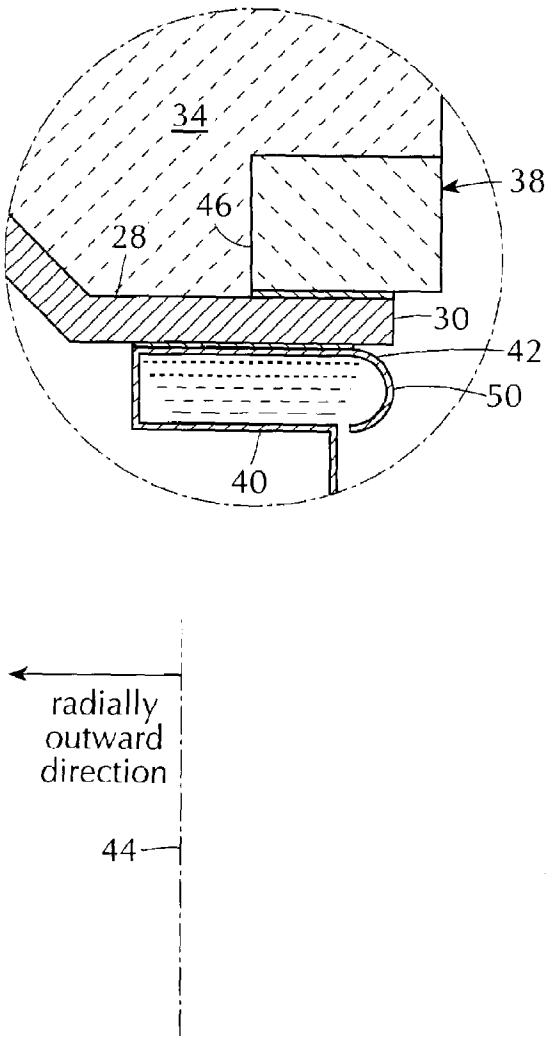
FIG. 2B Prior Art
FIG. 2B is an enlarged detail of the structure in circle 2B of FIG. 2A.
Figure 2A:
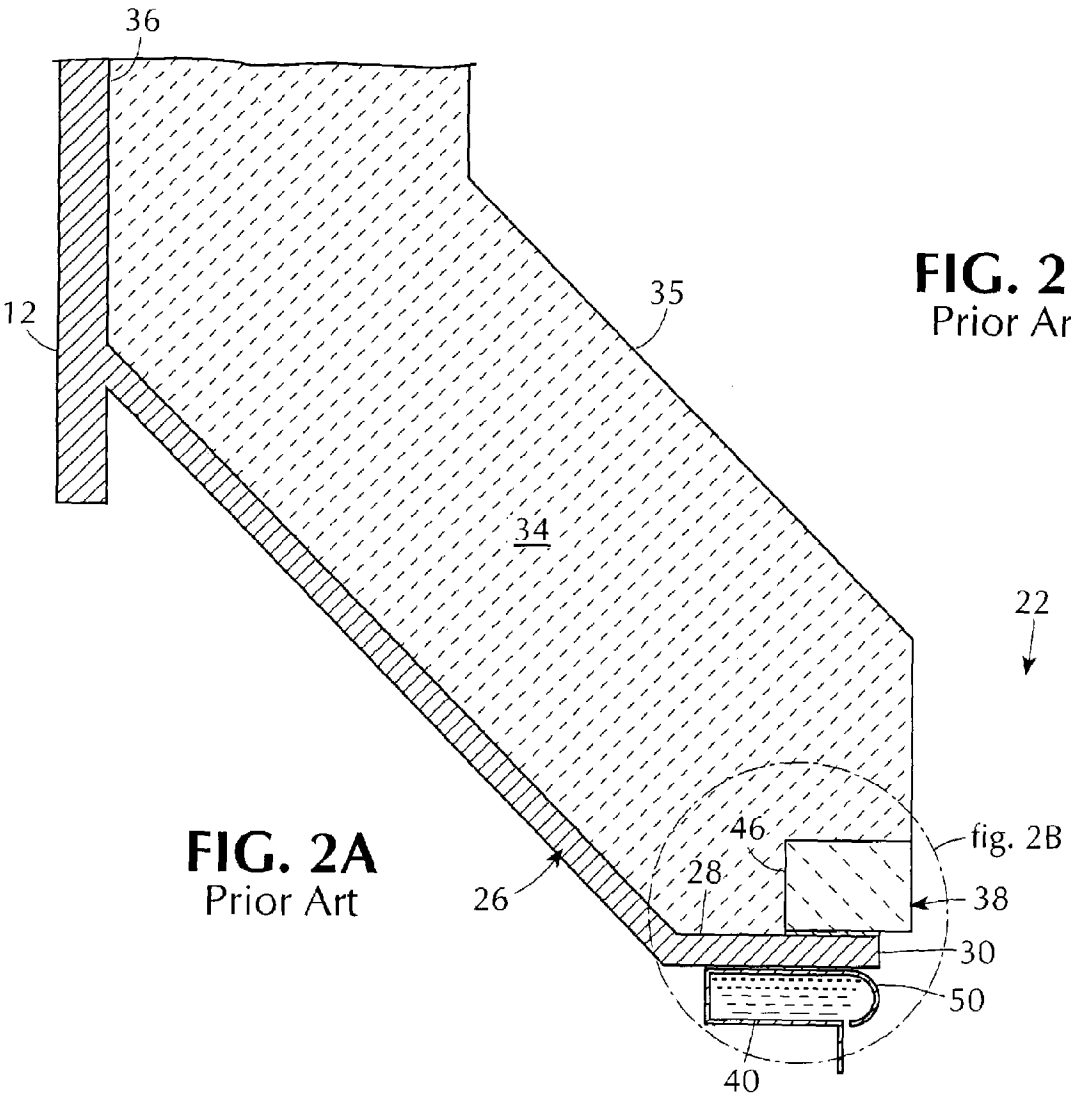
FIG. 2A Prior Art
FIG. 2A is a view similar to FIG. 1A, showing the prior art.

Referring to FIG. 2A a typical known gasifier includes a conical floor section 26 formed of substantially the same metal used to form the steel gasifier shell 12. The conical floor section 26 is provided with a generally horizontal portion 28 having a free edge 30. The free edge 30, also known as the leading edge, has a generally curved periphery, such as a circular periphery, although other peripheral shapes are conceivable.

A refractory lining 34, formed of a known ceramic material, overlays the conical floor section 26 and the horizontal floor portion 28. The refractory lining 34 also extends upwardly along an inside surface 36 of the gasifier shell 12. The refractory lining 34 protects the steel shell 12 and the steel conical floor section 26, including the horizontal section 28, from the extreme temperature conditions and thermal-chemical degradation that can occur to steel during a gasification process.

The refractory lining 34 usually includes refractory brick of the type schematically shown in FIG. 2A and identified by the reference number 38. The individual refractory bricks 38 have a generally rectangular cross section in all three dimensions.

A quench ring 40, of known construction, is joined to the undersurface of the horizontal floor portion 28 and includes a water cooling system that helps lower the temperature of the overlying floor portion 28. The quench ring 40 thus helps to retard metal wastage of the floor portion 28 due to thermal and thermal-chemical conditions inside the gasifier Thermal and thermal-chemical damage as well as slag damage can also occur to the quench ring 40, particularly at an upper radially inner surface portion 50 thereof.

Damage to the free edge 30 of the horizontal floor portion 28 and the surface 50 of the quench ring 40 is also attributable to molten slag that moves downwardly on the refractory lining 34 and into the gasifier throat 22.

Metal wasting of the horizontal floor portion 28 (FIG. 2A) is usually most severe at the free edge 30 and progresses radially outwardly from a center axis 44 (FIGS. 2A and 7) of the gasifier 10 to an equilibrium radius, although the equilibrium border is not necessarily at the same radius all around the gasifier axis 44.

For purposes of a simplified discussion the equilibrium radius can be considered to be the radial distance between the gasifier axis 44 and an outer end surface 46 (FIG. 2A), for example, of the refractory brick 34.

Progressive damage to the horizontal floor portion 28 will ultimately weaken the floor portion 28 to the extent that it is unable to sustain the overlying refractory 34. Thus the gasifier 10 may require shut-down for reconstructive work on the floor portion 28. Such reconstructive work usually includes replacement of a portion of the refractory lining 34, including the refractory brick 38, and possibly repair or replacement of the quench ring 40. These remedial procedures are extremely time consuming, labor intensive and costly. Any shut down of gasifier operation also results in substantial economic loss.

To deal with the problems of metallurgy wastage of the floor portion 28, wastage of the quench ring 40 and damage to the refractory lining 34 a horizontal floor portion 60 (FIGS. 1A and 1B), corresponding to the horizontal floor portion 28 of FIG. 2A, is provided with a replaceable floor edge insert 62, which can be formed of Incoloy 825® for example, and an annular ring of overlying hanging refractory bricks 66. The refractory bricks 66 are formed of any suitable known thermal shock resistant formulation to fulfill the refractory requirements of a particular feedstock composition.

Referring to FIGS. 1A, 1B, 3A, 3B and 3C the replaceable floor edge insert 62, in one embodiment, is in the shape of an annulus, including a radially inner portion 70 and a radially outer portion 72. The radially outer portion 72 (FIG. 3C) has a step-like formation 76, also referred to as a mating profile, that includes a generally horizontal surface 78 and spaced vertical surfaces 80 and 82. The replaceable floor edge insert 62 also includes upper and lower horizontal surfaces 84 and 86.

The radially inner portion 70 (FIG. 3C) of the replaceable floor edge insert 62 is curved downwardly and radially inwardly at 88 from the upper horizontal surface 84 toward ridge 90, relative to the gasifier axis 44. The intersection or tangency between the upper horizontal surface 84 and the curved surface 88 is shown as the circle 92 in FIG. 3A. The radially inner portion 70 (FIG. 3C) is also curved upwardly and radially inwardly at 93 from the lower horizontal surface 86 toward the ridge 90. Radially oriented thermal expansion slots 64 (FIGS. 3A, 3B and 3C), approximately 5 mm wide, are formed or cut into the radial inner surface 70 and extend from the ridge 90 to a location line 65 (FIG. 3C) that is slightly beyond the tangency circle 92.

The horizontal floor portion 60 (FIG. 1B) is formed or machined with a finished edge 94 that has a step-like formation, also referred to as a mating profile. The mating profile of the finished edge 94 is of complementary shape to the step-like formation 76 at the radially outer portion 72 of the replaceable floor edge insert 62. Thus the mating profile of the finished edge 94 can engage the mating profile of the radially outer portion 72 of the replaceable floor edge insert 62 in the manner shown in FIGS. 1A and 1B.

Figure 3A:
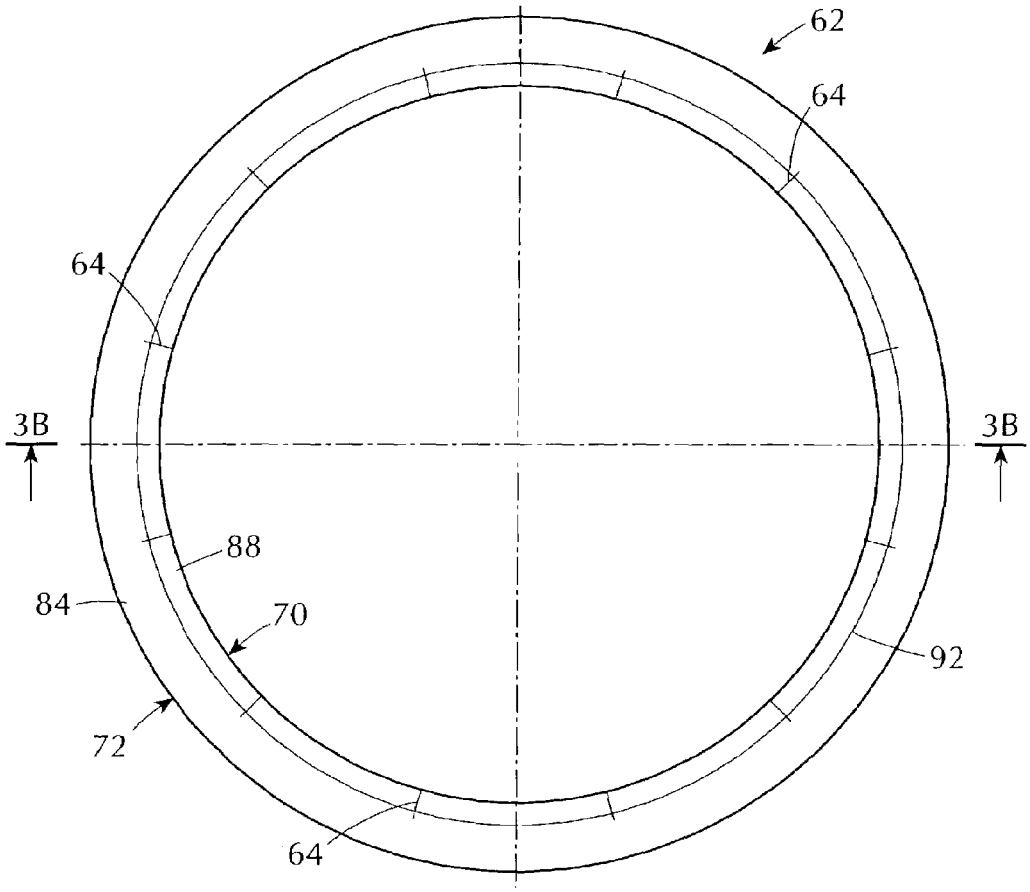
FIG. 3A is a plan view of a replaceable floor edge insert incorporating one embodiment of the invention.
Figure 3B:
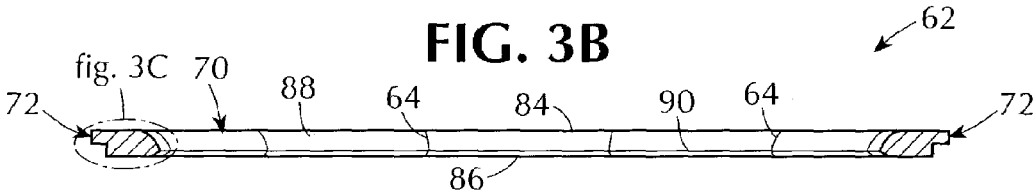
FIG. 3B is a sectional view taken on the line 3B—3B of FIG. 3A.
Figure 3C:
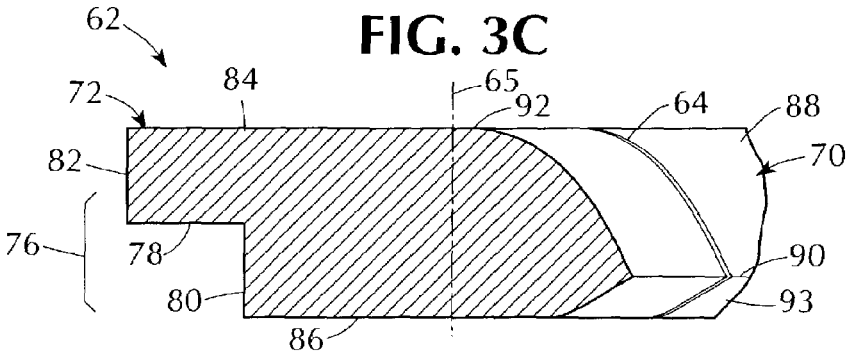
FIG. 3C is an enlarged detail of the structure in circle 3C of FIG. 3B.

As most clearly shown in FIGS. 3A and 3B the replaceable floor edge insert 62 is of annular form to correspond to the periphery of the finished edge 94 of the horizontal floor portion 60. The inner diameter of the insert 62 will depend on the size of the gasifier and can range from below 18 inches in diameter to above 50 inches in diameter.

It should be noted that the periphery of the finished edge 94 may not be exactly circular and can be of any or other geometrical shape that corresponds to the geometry of the gasifier 10. Thus the replaceable floor edge insert 62 will have a periphery that corresponds to the periphery of the finished edge 94 of the floor portion 60.

Preferably the mating geometries or mating profiles of the replaceable floor edge insert 62 and the finished edge 94 of the floor portion 60 will enable the replaceable floor edge insert 62 to remain in engagement with the finished edge 94 simply by gravity. Thus installation and/or replacement of the replaceable floor edge insert 62 can be accomplished in substantially less time than is required for conventional repair of a gasifier floor.

The replaceable floor edge insert 62 is preferably fitted to the floor portion 60 as a single unitary annulus. To facilitate installation of the replaceable floor edge insert 62, the insert 62 can be formed or cut into two or three segmental arcs of substantially equal extent and brought into the gasifier as separate segments. The segments or arcs of the insert 62 are then welded into a unitary construction in the gasifier prior to installation because it may be difficult or impossible to bring the replaceable annular insert 62, as a single unitary structure, into the gasifier 10. Installation of the replaceable floor edge insert 62 permits relatively easy repair and/or replacement of the insert 62 should there be a need for subsequent repair and/or replacement of the gasifier floor.

It should be noted that the replaceable floor edge insert 62 can be made of an alloy that is much more resistant to thermal and thermal chemical damage than the normal steel metallurgy of the gasifier shell 12 and gasifier floor 20. Thus the use of an alloy such as Incoloy825® to form the replaceable floor edge insert 62 will enable the floor edge insert to have a longer useful life than that of a typical floor edge area that is made of the same metal as the gasifier floor 20.

Other embodiments of the replaceable floor edge insert can be mated to the horizontal floor portion 60 by means of other different complementary mating profiles.

Figure 4A:
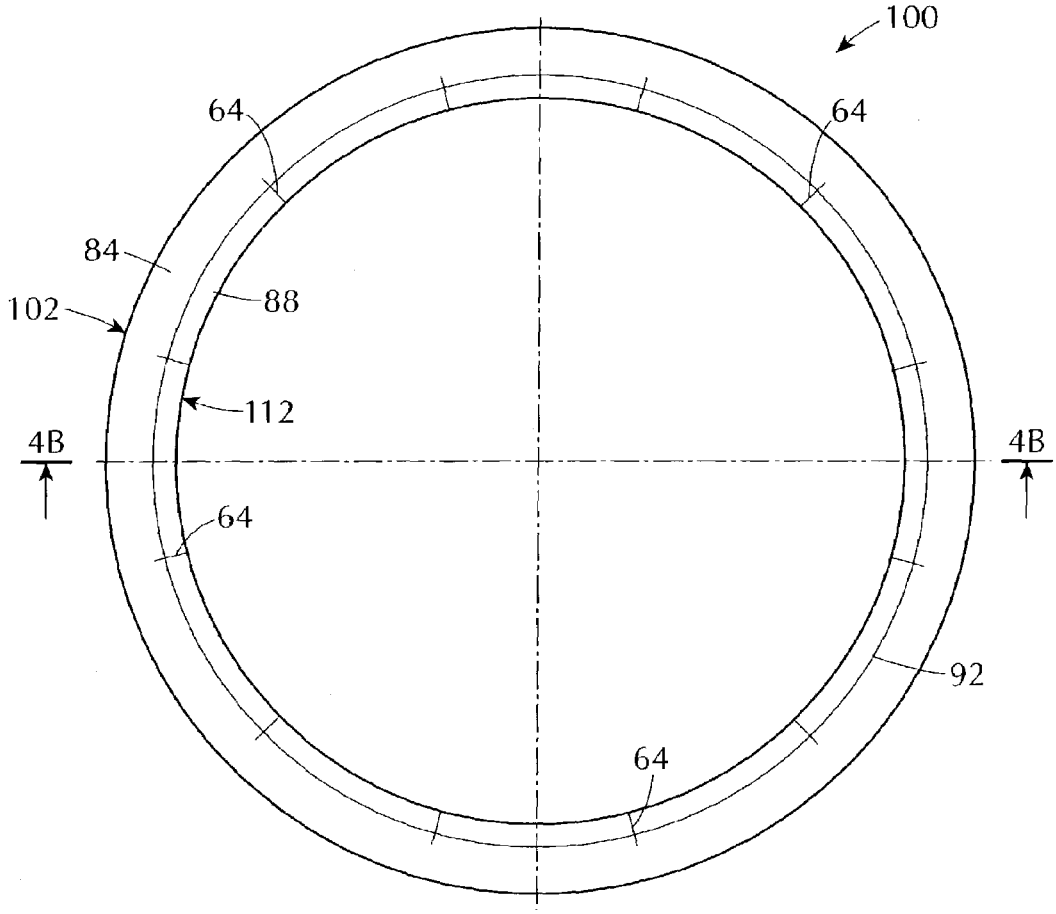
FIGS. 4A–4C and FIGS. 5A–5C show other embodiments of the replaceable floor edge insert portion of the invention.
Figure 4B:
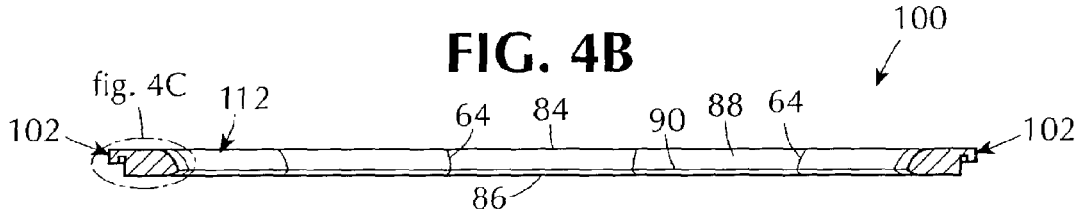
Figure 4C:
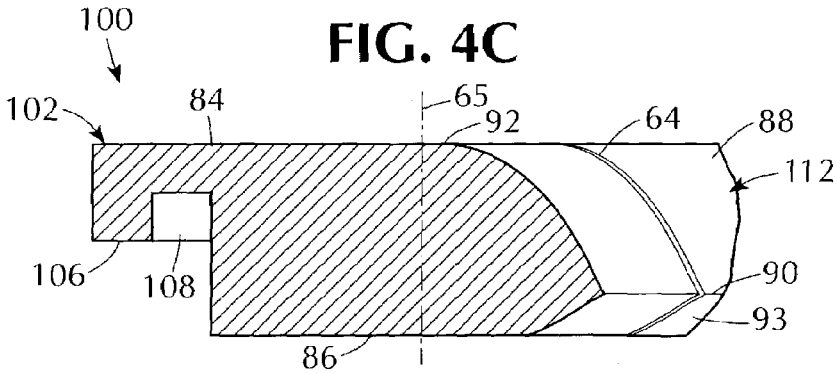

Another embodiment of the replaceable floor edge insert is generally indicated by the reference number 100 in FIGS. 4A, 4B and 4C. The replaceable floor edge insert 100 is formed with a radially outer mating profile 102 that defines a tenon portion 106 and a mortise portion 108. The replaceable floor edge insert 100 has a radially inner surface 112 that is identical to the radially inner portion 70 of the replaceable floor edge insert 62.

Before installing the replaceable floor edge insert 100 at the horizontal floor portion 60, the floor portion 60 is provided with a finished edge (not shown) having a mortise and tenon mating profile complementary to the tenon and mortise formations 106 and 108 of the replaceable floor edge insert 100.

As previously described for the replaceable floor edge insert 62, the replaceable floor edge insert 100 can be brought into the gasifier in two or three unwelded sections and welded into a single unitary insert in the gasifier before being positioned and engaged with the corresponding mating finished edge of the floor portion 60.

Figure 5A:
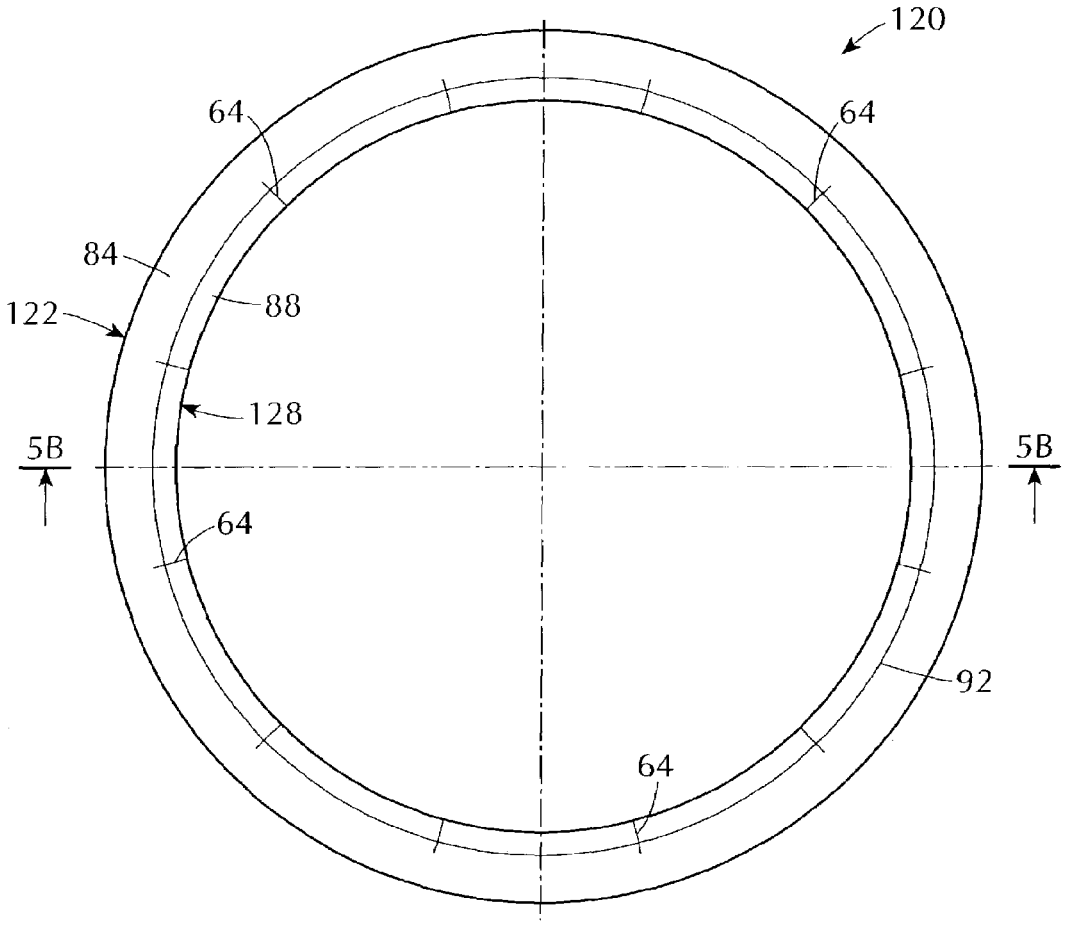
Figure 5B:
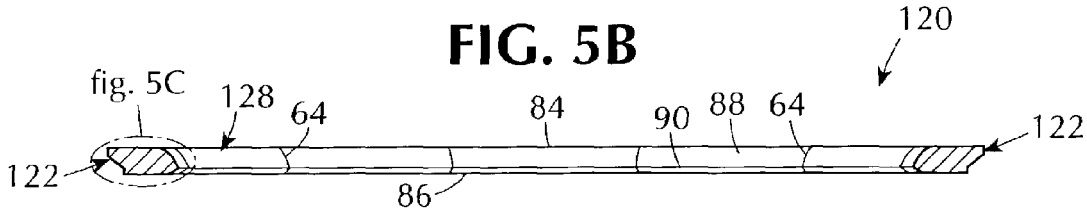
Figure 5C:
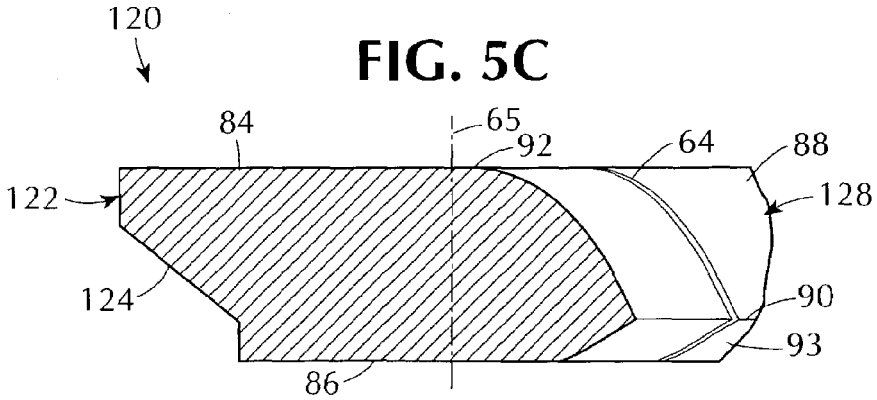

A further embodiment of the replaceable floor edge insert is generally indicated by the reference number 120 in FIGS. 5A, 5B and 5C. The replaceable floor edge insert 120 includes a radially outer surface 122 having an inclined step-like mating profile 124. The replaceable floor edge insert 120 also includes a radially inner surface 128 identical to the radially inner portion 70 of the replaceable floor edge insert 62.

Before installation of the replaceable floor edge insert 120 into the gasifier the horizontal floor portion 60 is provided with a finished edge (not shown) of complementary mating profile with the inclined step-like mating profile 124 of the replaceable floor edge insert 120. The replaceable floor edge insert 120 can be formed as a single unitary piece and then cut into two pieces or formed as two separate pieces. The separate pieces are brought into the gasifier and installed in the manner similar to that described for the replaceable floor edge inserts 62 and 100.

It should also be noted that a two or three segment replaceable floor edge insert can be positioned as separate segments at the finished edge of the gasifier floor, without being welded into a unitary annular structure. However, when unwelded segments of the floor edge insert are installed at the finished edge of the gasifier floor, the adjacent ends of the unwelded segments should have an end to end relationship that provides a keystone type fitting arrangement.

Figure 1B:
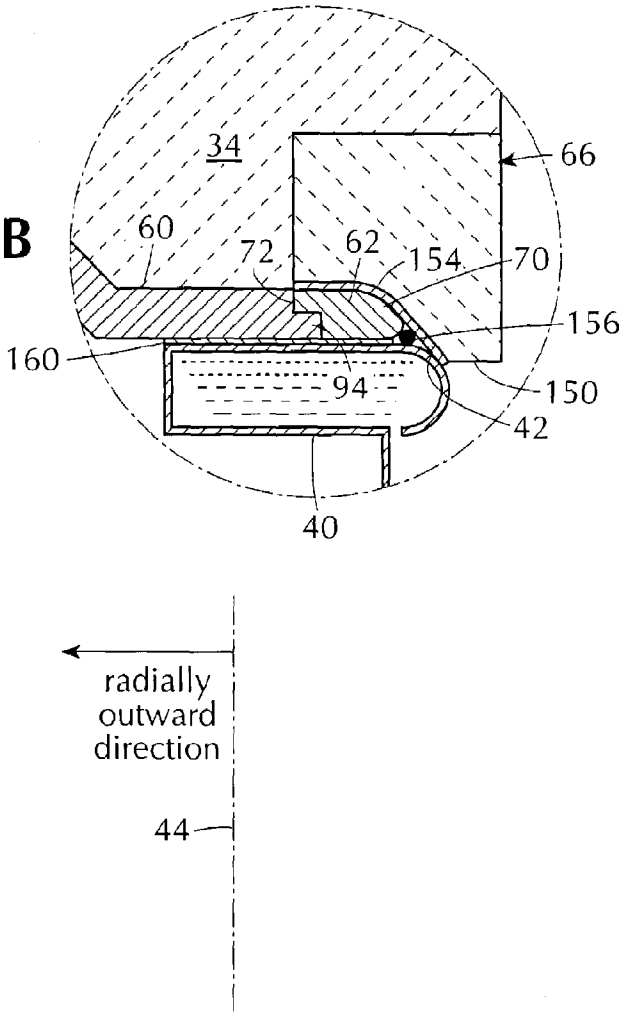
FIG. 1B is an enlarged detail of the structure in circle 1B of FIG. 1A.
Figure 1A:
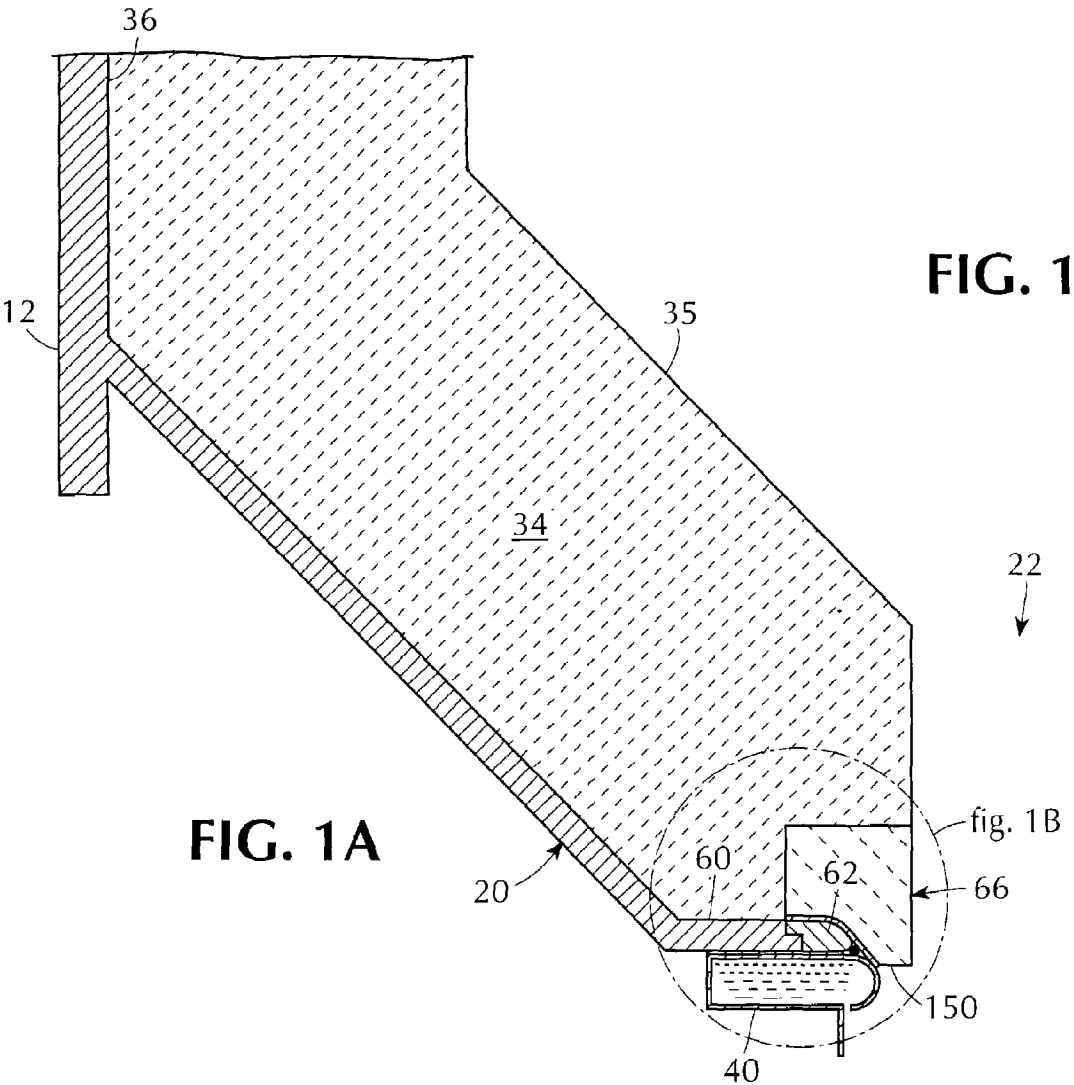
FIG. 1A is simplified fragmentary sectional view of a floor portion and throat portion of a gasifier as shown in FIG. 7, incorporating the present invention.

Referring to FIGS. 1A and 1B the refractory 34 includes refractory bricks, also known as hotface bricks, having a hotface surface 35 that is directly exposed to the environment in the gasification portion 16 of the gasifier 10, where gasification occurs. Hotface bricks are also provided at the throat 22 and generally wear faster than most other refractory bricks in the gasifier. Hotface bricks at the throat 22 thus need periodic replacement while major sections of the refractory 34 elsewhere in the unit often may remain in place for continued usage.

Each individual hanging brick 66 (FIGS. 1A, 1B and FIGS. 6A–6D) includes a top portion 132, opposite side portions 134 and 136, opposite end portions 140 and 142 and a bottom portion 144. The bottom portion 144 includes an appendage 150. The end portion 140 is of relatively short height and the appendage 150 extends a predetermined amount below the end portion 140. The appendage 150 is preferably formed such that the opposite end portion 142 is of relatively long height. The vertical extent of the appendage 150, which is the hanging portion of the refractory brick 66, is approximately equal to the difference in height between the relatively short end 140 and the relatively long end 142 but is largely dictated by the thickness of the floor portion 60.

Figure 6A:
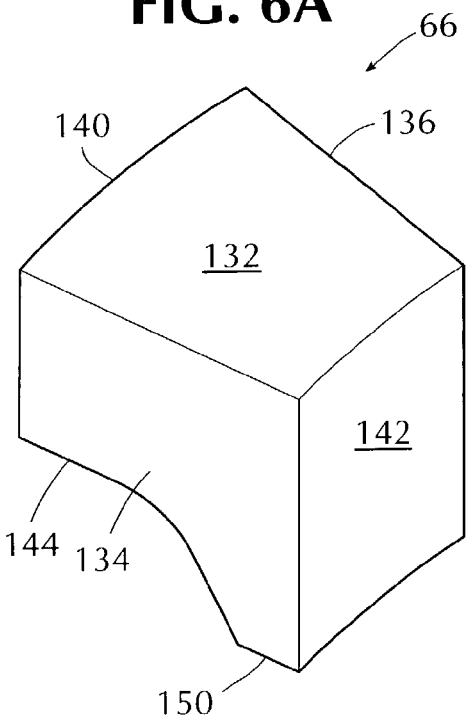
FIG. 6A is a simplified perspective view of a hanging refractory brick incorporating one embodiment of the invention.
Figure 6B:
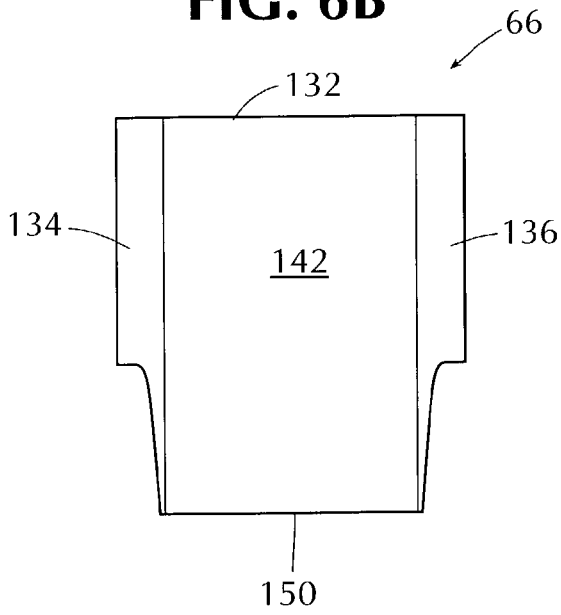
FIG. 6B is a front elevational view thereof.
Figure 6C:
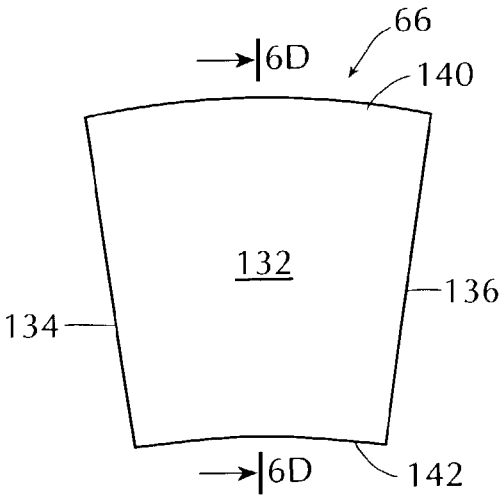
FIG. 6C is a top plan view thereof.
Figure 6D:
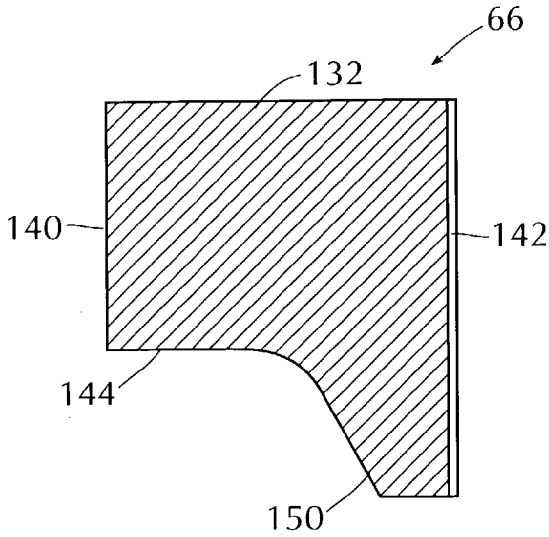
FIG. 6D is a sectional view taken on the line 6D—6D of FIG. 6C; and, FIG. 7 is a simplified partial schematic view of a gasifier incorporating the invention of FIG. 2A.

As most clearly shown in FIG. 6C the opposite side portions 134 and 136 diverge slightly with respect to each other, and the opposite end portions 140 and 142 are slightly curved. The diverging side portions 134 and 136, and the slightly curved end portions 140 and 142 are so formed because adjacent bricks 66 are arranged around a circular periphery of the throat 22.

Referring to FIGS. 1A and 1B the hanging brick 66 is installed at the throat portion 22 of the gasifier to overlie the upper surface 84 (FIG. 3C) of the replaceable floor edge insert 62, and to overhang the radially inner portion 70 of the replaceable floor edge insert 62. The appendage 150 (FIG. 1B) of the refractory hanging brick 66 also overhangs an upper surface portion 42 of the quench ring 40. The appendage 150 thus provides protection for the radially inner portion 70 of the replaceable floor edge insert 62 and also provides protection for the upper surface 42 of the quench ring 40 to prevent accumulation of slag, which can solidify and accumulate on the cool, upper surface of the quench ring. Such slag accumulation can lead to pluggage of the throat 22 and/or damage to the quench ring 40. Protection provided by the hanging brick 66 prolongs the life of the gasifier floor and the quench ring 40.

A refractory ceramic fiber paper 154 rated for at least 3000° F. and approximately 6 mm thick, for example, is provided between the refractory hanging brick 66 and the replaceable floor edge insert 62 and held in place with a suitable organic adhesive. The refractory paper 154 (FIG. 1B) also extends between the appendage 150 and the upper surface 42 of the quench ring 40.

A single coil of refractory ceramic fiber rope 156 approximately 13 mm in cross-section, for example, (FIG. 1B) is provided at the radially inner portion 70 of the replaceable floor edge insert 62, at the upper surface 42 of the quench ring 40 and underneath the refractory ceramic fiber paper 154. The refractory rope 156 is held in place by a suitable organic adhesive. The refractory hanging brick 66 helps envelop the refractory ceramic fiber rope 156 between the appendage 150 of the hanging brick, the radially inner portion 70 of the replaceable floor edge insert 62, and the upper surface 42 of the quench ring 40.

The refractory ceramic fiber paper 154 and the refractory ceramic fiber rope 156 help minimize the conductive and convective heating of the floor edge and the upper curved surface of the quench ring , thereby reducing thermal stresses and the likelihood of high temperature corrosion of these components. The refractory ceramic fiber paper 154 and the refractory ceramic fiber rope 156 also reduce the amount of conductive cooling experienced by the refractory hanging brick 66, which is beneficial since high thermal gradients cause high thermal stresses and increased risks of cracking the refractory hanging brick 66.

A known ring-like gasket 160 formed of coiled stainless steel ribbon impregnated with graphite is also provided between the quench ring 40, and the floor portion 60 and replaceable floor edge insert 62, to enhance the cooling effect of the quench ring upon the replaceable floor edge insert 62 and the floor portion 60, and to create a gas tight barrier between these components.

When installing the refractory hanging brick 66, it is preferred that no mortar be applied to the bottom surface 144 in contact with the refractory ceramic fiber paper 154, since mortar would substantially reduce or eliminate the desirable insulating characteristics of the refractory ceramic fiber paper 154.

The refractory hanging brick 66, by covering the replaceable floor edge insert 62, enhances the life of the gasifier floor 60 and also enhances the life of the quench ring 40. However, the hanging refractory brick 66 can also be used to protect gasifier floors with non-replaceable exposed leading edges.

Some advantages of the invention evident from the foregoing description include a replaceable floor edge insert that is easily installed and removed from a gasifier thereby hastening and simplifying a floor repair operation. Another advantage of the replaceable floor edge insert is that it can be made more resistant to thermal and thermal chemical damage then the normal metallurgy of the gasifier floor. A further advantage is the provision of hanging refractory brick with an appendage that provides a refractory shield for the floor edge and the quench ring. Prolongation of the operational life of the gasifier floor and the quench ring helps minimize shutdown periods of the gasifier and increases the productivity and profitability of the gasifier operation.

A further advantage is the provision of a novel method of facilitating the repair of a metal gasifier floor by incorporating a replaceable floor edge insert at a throat opening and a novel method of prolonging the life of the metal gasifier floor at the throat opening, by providing hanging refractory brick with an appendage to overlie the replaceable floor edge insert. The hanging refractory brick with the appendage thus covers the replaceable floor edge insert and also covers a vulnerable surface of a quench ring that underlies the gasifier floor at the throat opening.

In view of the above it will be seen that the several objects of the invention are achieved and other advantageous results attained. As various changes can be made in the above constructions and methods without departing from the scope of the invention, it is intended that all matter contained in the above description or shown in the accompanying drawings shall be interpreted as illustrative and not in a limiting sense.

What is claimed is:

1. In a gasifier having a throat section and a metal floor with a throat opening at the throat section, the throat opening in the metal floor being defined by an inner peripheral edge of the metal gasifier floor, and the metal gasifier floor has an overlying refractory material, the improvement comprising a hanging refractory brick for the overlying refractory material of the gasifier floor at the inner peripheral edge of the metal floor, the hanging refractory brick having opposite end portions, opposite side portions, a top portion and a bottom portion, the bottom portion including an appendage, the appendage having a vertical extent that extends a predetermined amount below one of the opposite end portions, the vertical extent of the appendage being selected to overhang a portion of the inner peripheral edge of the metal gasifier floor.

2. The hanging refractory brick as claimed in claim 1, wherein the appendage is formed such that one of the opposite end portions is of relatively short height and the other opposite end portion is of relatively long height, and the vertical extent of the appendage is approximately equal to the difference in height of the relatively short end portion and the relatively long end portion.

3. The hanging refractory brick as claimed in claim 1 wherein a quench ring underlies the gasifier floor at the inner peripheral edge of the gasifier floor and the quench ring has an upper surface, and the improvement comprises the selected vertical extent of the appendage being sufficiently long to overhang the upper surface of the quench ring.

4. The hanging refractory brick as claimed in claim 3 wherein a refractory ceramic fiber paper is provided between the hanging brick and the gasifier floor and between the hanging refractory brick and the upper surface of the quench ring.

5. The hanging refractory brick as claimed in claim 3 wherein a refractory ceramic fiber rope is provided under the hanging refractory brick between the gasifier floor and the upper surface of the quench ring.

6. In a gasifier having a throat section and a metal floor with a throat opening at the throat section, the throat opening in the metal floor being defined by an inner peripheral edge portion of the metal floor, and the metal gasifier floor having an overlying refractory material, the improvement comprising a replaceable metallic floor edge insert for positioning at the inner peripheral edge portion of the metal gasifier floor when the inner peripheral edge portion is finished to form a first predetermined mating profile in cross-section, the replaceable floor edge insert having a radially inner edge portion that becomes a leading edge or free edge of the metal floor, and a radially outer edge portion, the radially outer edge portion having a second predetermined mating profile in cross-section, complementary to the first predetermined mating profile of the finished inner peripheral edge portion to permit engagement of the replaceable metallic floor edge insert with the finished inner peripheral edge portion of the metal gasifier floor such that the replaceable metallic floor edge insert forms a removable extension of the metal gasifier floor.

7. The replaceable floor edge insert as claimed in claim 6 wherein the radially outer edge portion of the replaceable floor edge insert, in cross-section is of stepped shape in cross-section, complementary to a stepped cross-section of the finished inner peripheral edge portion of the gasifier floor to permit replaceable positioning of the replaceable floor edge insert at the stepped inner peripheral edge portion of the gasifier floor.

8. The replaceable floor edge insert as claimed in claim 6 wherein the radially outer edge portion of the replaceable floor edge insert has a tongue and groove formation in cross-section, complementary to a tongue and groove formation at the finished inner peripheral edge portion of the gasifier floor to permit replaceable mating of the replaceable floor edge insert with the tongue and groove formation at the finished inner peripheral edge portion of the gasifier floor.

9. The replaceable floor edge insert as claimed in claim 6 wherein the radially outer edge portion of the replaceable floor edge insert includes complementary mating means that are complementary to mating means at the finished inner peripheral edge portion of the gasifier floor for replaceable positioning of the replaceable floor edge insert at the finished inner peripheral edge portion of the gasifier floor.

10. The replaceable floor edge insert as claimed in claim 6 wherein the replaceable floor edge insert is one annular member.

11. The replaceable floor edge insert as claimed in claim 6 wherein the replaceable floor edge insert is an annulus comprised of a plurality of circular segments.

12. The replaceable floor edge insert as claimed in claim 6 wherein the metal gasifier floor has an overlying refractory material, and the improvement further comprises a hanging refractory brick for the overlying refractory material of the gasifier floor at the inner peripheral edge of the gasifier floor, the hanging refractory brick having opposite end portions, opposite side portions, a top portion and a bottom portion, the bottom portion including an appendage, the appendage having a vertical extent that extends a predetermined amount below one of the opposite end portions, the vertical extent of the appendage being selected to overhang a portion of the inner peripheral edge of the metal gasifier floor.

13. The combination as claimed in claim 12 wherein the appendage is formed such that one of the opposite end portions is of relatively short height and the other opposite end portion is of relatively long height, and the vertical extent of the appendage is approximately equal to the difference in height of the relatively short end portion and the relatively long end portion.

14. The combination as claimed in claim 12 wherein a quench ring underlies the gasifier floor at the inner peripheral edge portion of the gasifier floor and the quench ring has an upper surface, and wherein the improvement comprises the selected vertical extent being the appendage is sufficiently long to overhang the upper surface of the quench ring.

15. The combination as claimed in claim 14 wherein a refractory ceramic fiber paper is provided between the hanging brick and the replaceable floor edge insert and between the hanging refractory brick and the upper surface of the quench ring.

16. The combination as claimed in claim 14 wherein a refractory ceramic fiber rope is provided under the hanging refractory brick between the replaceable floor edge insert and the upper surface of the quench ring.

* * * * *